US005231952A

United States Patent [19]

Tenniswood, David M.

[11] Patent Number: 5,231,952

[45] Date of Patent: Aug. 3, 1993

[54] COMPACT, STOWABLE MARKER DEVICE FOR UNDERWATER LOCATION

[76] Inventor: Tenniswood, David M., 1080 Pilgrim, Birmingham, Mich. 48009

[21] Appl. No.: 877,483

[22] Filed: May 1, 1992

[51] Int. Cl.[5] ..... B63B 45/00

[52] U.S. Cl. ..... 116/210; 116/DIG. 8; 441/11; 441/26

[58] Field of Search ..... 116/210, DIG. 8, DIG. 9; 441/6, 9, 11, 26

[56] References Cited

U.S. PATENT DOCUMENTS

| | | | |
|---|---|---|---|
| 2,569,977 | 2/1951 | Dickinson | 441/9 |
| 3,171,128 | 2/1965 | Shattuck | 116/210 X |
| 4,103,379 | 8/1978 | Wolfe | 441/11 |
| 4,123,813 | 11/1978 | Adams | 441/11 |
| 4,433,638 | 2/1984 | Ashline | 441/11 X |

*Primary Examiner*—Daniel M. Yasich

*Attorney, Agent, or Firm*—Flynn, Thiel, Boutell & Tanis

[57] ABSTRACT

A marker device for marking an underwater location is provided and comprises a heavier-than-water weight member including a reel thereon, an elongated connector line attached to the weight member and wrapped on the reel when the marker device is not in use and unwrapped from the reel when a location is to be marked, an inflatable/deflatable marker balloon on the connector line and stored on the weight member in the deflated condition when the marker device is not in use and removed from the weight member for inflation when a location is to be marked, and valve means communicated to the marker balloon for permitting introduction of gas therein to inflate the balloon and release of gas therefrom for deflating the balloon. The marker device further may comprise a cover member for releasably engaging the weight member when the connector line is wrapped on the reel and the balloon is stored in the deflated condition on the weight member so as to enclose the connector line and the balloon in a compact arrangement or package.

20 Claims, 3 Drawing Sheets

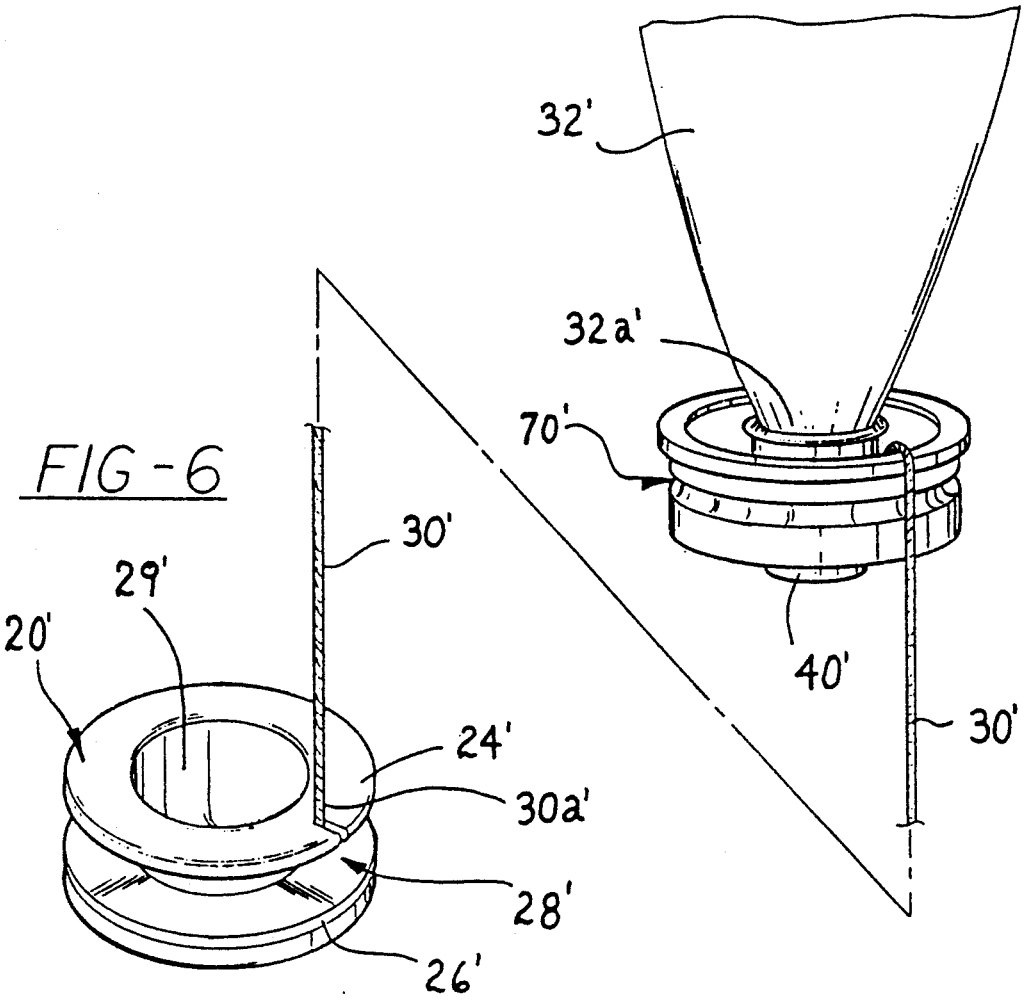
FIG-6
FIG-7
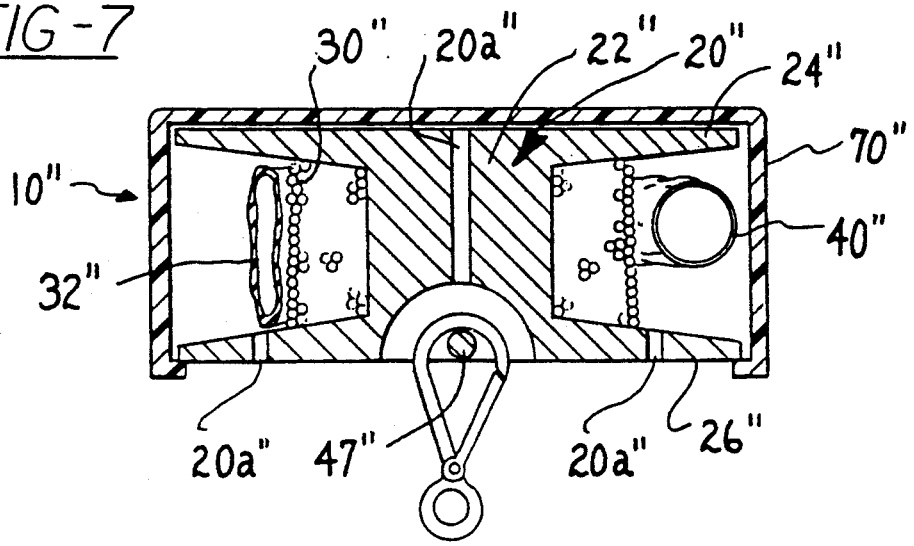

COMPACT, STOWABLE MARKER DEVICE FOR UNDERWATER LOCATION

FIELD OF THE INVENTION

The present invention relates to a compact, stowable marker device for marking an underwater location.

BACKGROUND OF THE INVENTION

Scuba divers oftentimes need to mark a particular underwater location to which the diver wishes to return or to mark the location for other divers. A common underwater marker used to this end comprises a metal (e.g., lead) weight of some type and a string attached at one end to the lead weight and to a plastic bottle at the other end. The lead weight is placed at the underwater location to be marked. The plastic bottle connected to the weight by the string floats on the surface of the water to provide a visible marker of the location.

The marker described above is quite bulky and awkward to stow on the dive boat as a result of the components used. Moreover, the marker is quite bulky and awkward for the diver to carry underwater. As a result, the marker oftentimes is thrown overboard from the dive boat at the location to be marked rather than being carried with the diver as the diver traverses the sea, lake or river bottom.

It is an object of the invention to provide an improved underwater marker device that is compact in configuration and readily stowable on a boat and on a diver (or other user such as a fisherman) to facilitate marking of an underwater location.

It is another object of the invention to provide an improved underwater marker device that is readily deployed for use at the underwater location to be marked and is readily returned to compact configuration after use for stowage on a boat or on a diver for reuse in marking another underwater location.

It is still another object of the invention to provide an improved inflatable marker balloon/valve assembly for use in an underwater marker device wherein the assembly permits underwater inflation of the marker balloon by a diver and deflation of the marker balloon by the diver.

SUMMARY OF THE INVENTION

The present invention contemplates a marker device for marking an underwater location wherein the marker device comprises a heavier-than-water weight member having a reel thereon, and an elongated connector line attached to the weight member and wrapped on the reel when the marker device is not in use and unwrapped from the reel when a location is to be marked. An inflatable/deflatable marker balloon is connected to the connector line and stored on the weight member in the deflated condition when the marker device is not in use and removed from the weight member for inflation when a location is to be marked. Valve means (which may comprise one or more valves) is provided in communication with the marker balloon for permitting introduction of gas therein to inflate the balloon and release of gas therefrom for deflating the balloon.

Preferably, the marker device includes a cover member for releasably engaging the weight member when the connector line is wrapped on the reel and the balloon is stored in the deflated condition on the weight member so as to enclose the connector line and the balloon in a compact arrangement or package.

In one embodiment of the invention, the inflatable/deflatable marker balloon is wrapped on the reel in the deflated condition about the wrapped connector line when the marker device is not in use and is unwrapped from the reel when a location is to be marked. In this embodiment of the invention, the marker device further includes a cover member releasably engaging the weight member when the connector line and the weight member are wrapped on the reel so as to enclose the connector line and the marker balloon in a compact package. The cover member is removed from the weight member when the connector line and the marker balloon are to be unwrapped. The cover member is reengagable with the weight member after the connector line and the marker balloon are unwrapped and released to mark the location so as to clamp the connector line on the weight member, thereby maintaining a desired length of connector line at the marked location.

In another embodiment of the invention, the inflatable/deflatable marker balloon is sealingly connected to the cover member. The balloon in the deflated condition is enclosed between the cover member and the weight member when the cover member is engaged to the weight member. Preferably, the deflated balloon is received in a central pocket on the weight member and about which pocket the connector line reel is disposed. The valve is disposed on the cover member in communication with the balloon for permitting introduction of gas therein to inflate the balloon and release of gas therefrom for deflating the balloon.

In the aforementioned embodiments of the invention, the valve means preferably comprises one or more gas inlet/outlet apertures through which gas can be introduced/released to inflate/deflate the balloon, and a valve member openable by application of gas pressure at the apertures (e.g., by the diver's blowing through the apertures) to inflate the balloon and closeable relative to the apertures by gas pressure in the inflated balloon after application of the gas pressure is discontinued so as to maintain inflation of said balloon. A gas release member is actuable from outside the balloon to open the valve member to release gas from the inflated balloon to deflate the balloon.

The present invention also contemplates a marker balloon and valve assembly for an underwater marking device wherein the assembly comprises the aforementioned inflatable/deflatable balloon and valve means connected in gas flow communication to the balloon.

The objects and advantages of the invention will become more readily apparent from the following detailed description and drawings.

DESCRIPTION OF THE DRAWINGS

FIG. 6 is a perspective view of the marker device of FIG. 5 after deployment for location marking purposes.

FIG. 7 is a sectional view of a marker device in accordance with still another embodiment of the invention prior to deployment for location marking purposes.

DETAILED DESCRIPTION OF THE INVENTION

Figure 1:
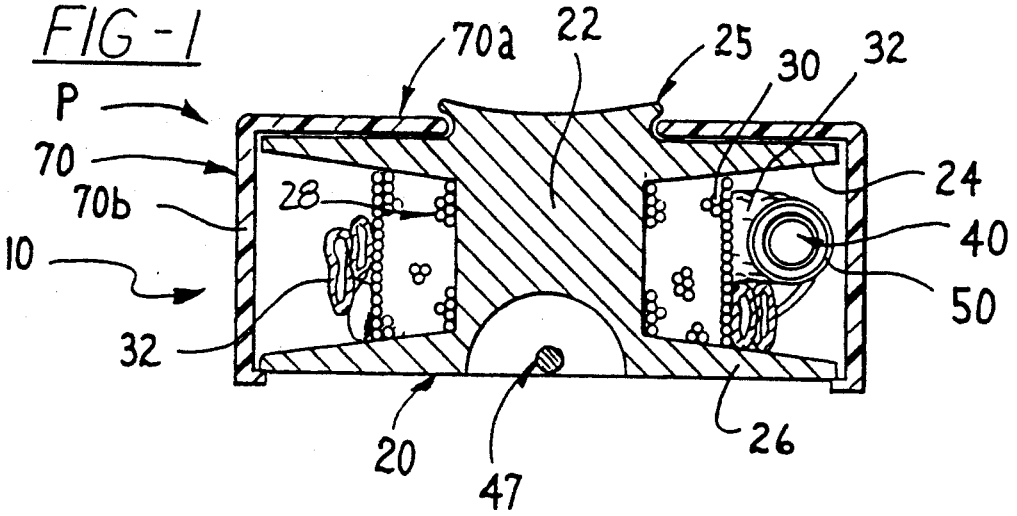
FIG. 1 is a sectional view of a marker device in accordance with one embodiment of the invention prior to deployment for location marking purposes.
Figure 2:
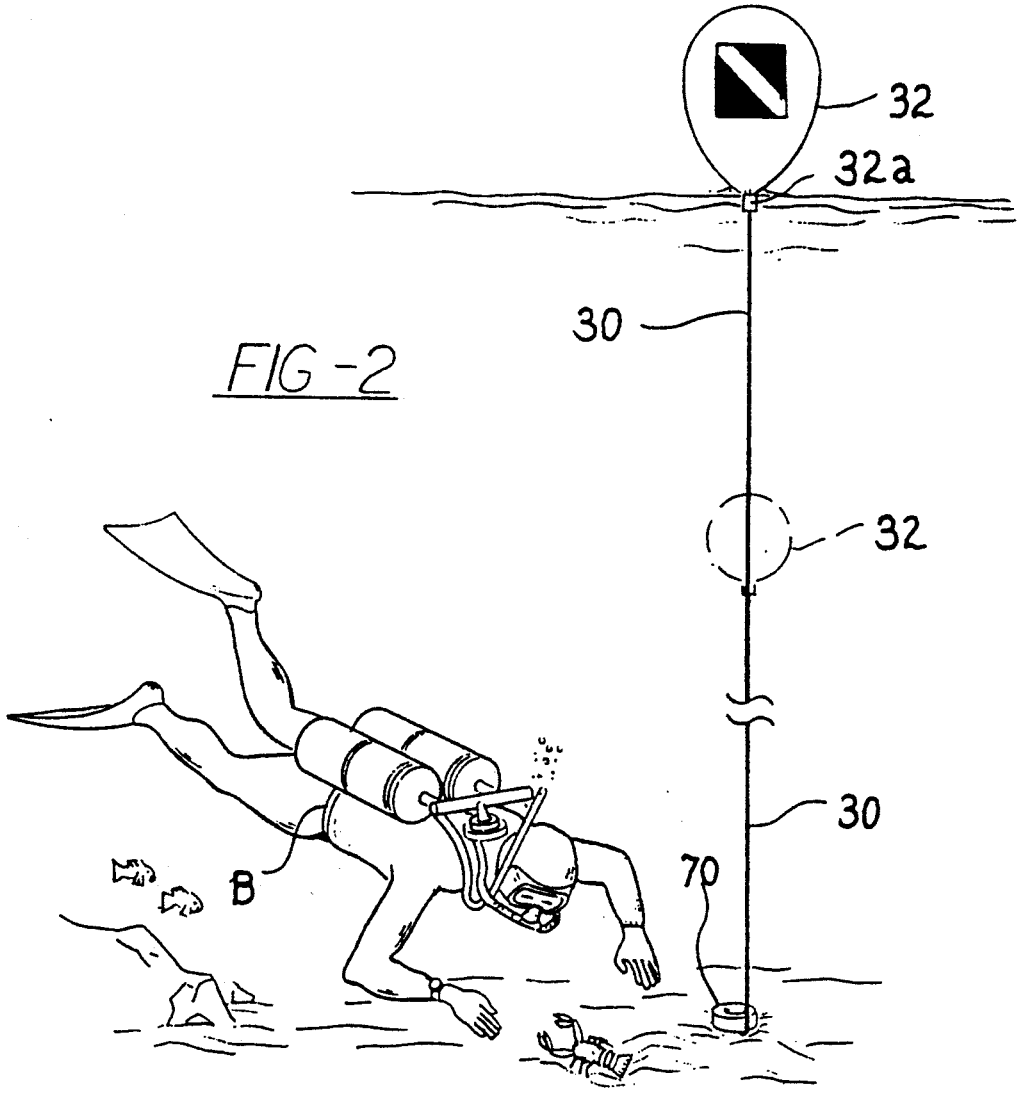
FIG. 2 is a perspective view of the marker device of FIG. I after deployment to mark a location.
Figure 3:
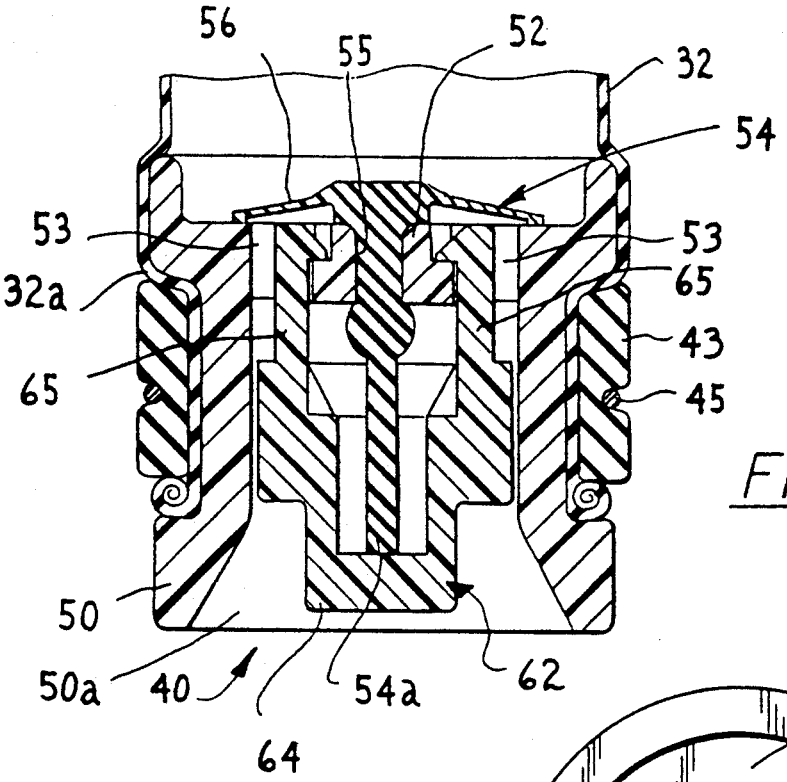
FIG. 3 is a sectional view of the valve means received in the throat of the balloon.

Referring to FIGS. 1-3, a marker device 10 in accordance with one embodiment of the invention is illustrated. FIG. 1 illustrates the marker device 10 as assembled in a compact, easily stowable package or arrangement P. FIG. 2 illustrates the marker device 10 deployed for marking an underwater location; e.g., the location where the lobster is shown in FIG. 2. Although the marker device 10 is described hereinbelow with respect to use by a scuba diver, the invention is not so limited since the marker device 10 can be also by used snorkelers, fisherman, and any other user wishing to mark an underwater location.

The marker device 10 comprises a heavier-than-water weight member 20 typically molded or cast from a heavy metal, such as preferably lead. The invention is not limited to use of any particular material for the weight material, however, so long as the desired weight is used for holding the marker device in position under the water. The weight member 20 comprises a central, axially extending hub 22 and first and second peripheral flanges 24,26 of circular profile extending radially from the hub and spaced apart to define a reel 28 on which an elongated connector line 30 and an inflatable/deflatable marker balloon 32 connected to the line 30 are wrapped (stored) in the compact, stowable arrangement P shown in FIG. 1. As mentioned, the weight member 20 can be molded or cast from lead to the configuration shown in FIG. 1. A typical weight for a lead weight member 20 used in practicing the invention is 1-2 pounds but other weights can be used.

The elongated connector line or string 30 may comprise any suitable plastic or other material such as; e.g., orange Dacron ® string of 20-50 pound test. One end of the connector line 30 is connected to the weight member 20 by tying around the hub 22. The other end of the connector line 30 is connected to the balloon 32 about the throat 32*a* of the balloon 32; e.g., as shown in FIG. 3. The length of connector line used will depend on the anticipated depth of the dive. For example, a connector line length of 40 feet can be used for dives to depths between 25 and 35 feet.

As shown in FIG. 1, the connector line 30 is wrapped on the reel 28 of the weight member 20 when the marker device 10 is in the compact assembled package; i.e., when the marker device is not in use. The balloon 32 in the deflated condition is wrapped on the wrapped connector line 30 when the marker device 10 is in the compact assembled package P.

The inflatable/deflatable marker balloon 32 comprises a conventional rubber balloon having a reduced-size throat 32*a*. The balloon 32 may be any color which is readily visible to the diver underwater or observer above water. For example, a yellow balloon or orange balloon can be used. The balloon can be printed with a representation of a diver warning flag (see FIG. 2) indicating a diver may be below the water surface.

The valve 40 is sealingly received in the throat or end 32*a* of the balloon 32 as shown best in FIG. 3. A rubber band 43 and the end 45 of the connector line 30 are wrapped tightly about the throat 32*a* as shown in FIG. 3 to insure air tight connection. The valve 40 (FIG. 3) is adapted to communicate with the balloon interior and permit introduction of air blown from the diver's mouth into the balloon 32 to inflate it and to release the gas therefrom for deflating the balloon 32.

Figure 4:
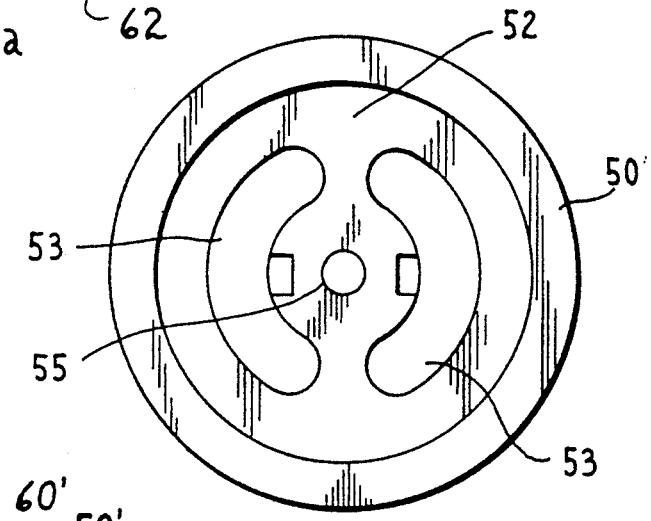
FIG. 4 is a top elevational view of the valve housing.

The valve 40 comprises a cylindrical housing 50 about which the throat 32*a* of the balloon 32 is sealingly engaged using the rubber band 43 and connector line end 45. The housing includes a cross member 52 having a plurality of gas inlet/outlet apertures 53 (two apertures shown in FIG. 4) through which the air blown from the diver's mouth can be introduced/released to inflate/deflate the balloon 32. The valve 40 comprises an elastomeric, umbrella valve member 54 having a valve stem 54*a* received and located in an aperture 55 in the cross member 52 and a flexible, circular valve head 56 overlying the apertures 53 as shown in FIG. 3.

The flexible valve head 56 is openable relative to the apertures 53 by application of the gas (air) pressure at the apertures 53 blown from the diver's mouth. For example, the valve head 56 will be opened when the diver blows air into the housing 50 at opening 50*a*. The air blown into the housing opening 50*a* will force the valve head 56 (FIG. 3) to open so that the air can flow through the apertures 53 into the balloon 32. In this way, the diver can readily inflate the balloon 32 underwater at the location to be marked. Once the balloon 32 is suitably inflated, the diver simply stops blowing air into the housing 50. The air pressure inside the inflated balloon 32 will act to force the valve head 56 closed onto the cross member 52 over the apertures 53, thereby maintaining the inflated condition of the balloon 32. The valve 40 shown in FIG. 3 is available commercially from Vernay Laboratories, Inc. Yellow Springs, Ohio. The invention is not limited to the particular valve 40 shown.

The gas release member 62 includes an end 64 actuable from outside the balloon 32 and legs 65 extending through the apertures 53 for engaging the valve head 56 when the balloon 32 is to be deflated. For example, to deflate the balloon 32, the diver pushes on the end 64 of the release member 62 to disengage the valve head 56 from the cross member 52 and thereby allow the pressurized air in the balloon 32 to escape through the apertures 53 past the end 64.

Although a single valve 40 is described and shown for admitting and releasing gas (e.g., air) to/from the balloon, those skilled in the art will appreciate that a separate gas admission valve and separate gas exhaust valve could also be used in practicing the invention. The term valve means as used in the claims is intended to means one or more valves that allow entry of gas to the balloon for inflation and exhausting of gas for deflation of the balloon 32.

The marker device 10 is shown in FIG. 1 as including a cover member 70 releasably engaging the weight member 20. The cover member 70 preferably is made of a suitable plastic material, such as nylon, etc., so that the circular upper wall 70*a* thereof will snap fit onto a circular protrusion 25 of the weight member 20 and the cylindrical, peripheral wall 70*b* thereof will snap fit onto the flange 26 of the weight member 20 as shown. As is apparent, when the cover member 70 is so snap fit, the connector line 30 and the deflated balloon 32 wrapped on the reel 28 are enclosed between the weight member and the cover member in the compact, easily stowable package P which is readily carried on the dive (or fishing) boat and by the diver underwater as the diver traverses the bottom of the body of water. For example, the marker device 10 as assembled in the compact, disc-shaped package P of FIG. 1 can be carried conveniently on the diver's belt B or in a pocket of his vest or body suit. Alternately, a clip (or other connector on the diver's belt, vest, etc.) can be coupled to cross pin 47 to attach the marker device to the diver (see FIG. 7 showing a clip).

When the diver desires to mark a particular location underwater, the diver removes the cover member 70 from the weight member 20 by sliding the cover member up to gain access to the wrapped connector line 30 and the deflated balloon 32. The diver removes (unwraps) the deflated balloon and a short length of the connector line from the reel 28. The diver then blows air from his mouth into the valve housing 50 via the valve 40 in the manner described above to inflate the balloon 32 to the desired degree. The air in the diver's lungs an thus constitute an air supply for inflating the balloon.

The diver then releases the inflated balloon 32 to float to the surface of the water where it will mark the location. Alternately, the balloon 32 can be released so as to be suspended under the water surface (see phantom lines in FIG. 2) to mark the location for a diver. The connector line 30 readily unwinds from the reel 28 until the balloon 32 reaches the desired position. The balloon will expand in size as it floats toward the surface s a result of the decreasing ambient pressure thereon. After the balloon 32 is at the desired position, the diver can adjust the length of the connector line 30 and then clamp the connector line to the weight member 20 by reengaging the cover member 70 onto the weight member 20 as shown in FIG. 2 (i.e., by snapping the cover member back onto the weight member protrusion 25 and flange 26). In this way, the desired length of connector line 30 is maintained at the marked location.

When the diver desires to remove the deployed marker device 10 from the marked location for use at another location or to stow it on the dive boat for subsequent use, the diver retrieves the inflated balloon 32 underwater or above the water, if the diver is in the dive boat, and simply presses the gas release member 62 (i.e., end 64 thereof) with a finger so as to unseat (open) the valve head 56 from the cross member 52 to allow the air to escape from the balloon 32 until it is suitably deflated. The diver then removes the cover member 70 from the weight member 20 and wraps the connector line 30 and then the deflated balloon 32 n the reel 28 as shown in FIG. 1. The diver then saps the over member 70 back onto the weight member 20 as also shown in FIG. 1, thereby providing the compact, readily stowable marker device 10.

Figure 5:
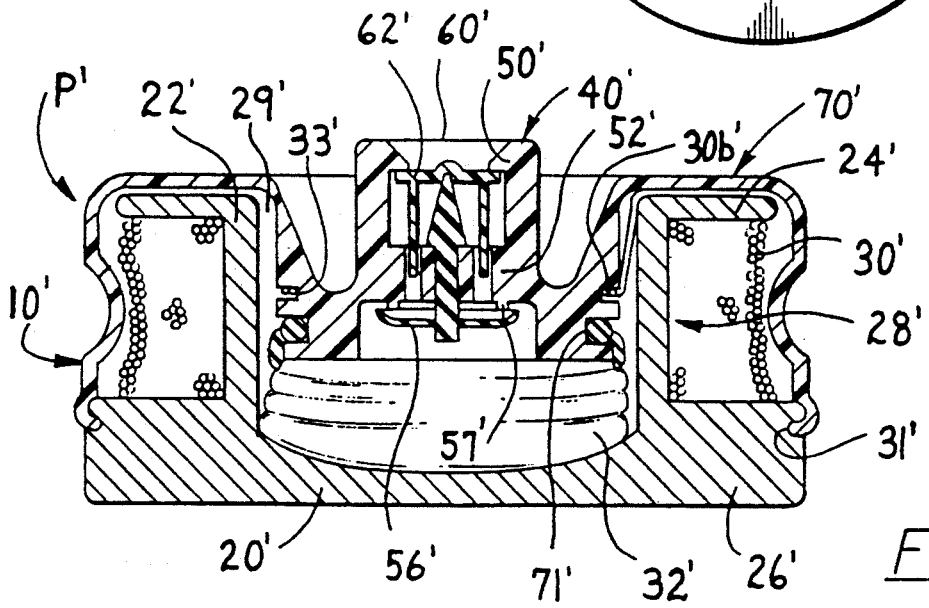
FIG. 5 is a sectional view of a marker device in accordance with another embodiment of the invention prior to deployment for location marking purposes.

Referring to FIGS. 5 and 6 wherein like reference numerals primed are used to designate like features of FIGS. 1-3, a maker device 10' in accordance with another embodiment of the invention is shown. FIG. 5 illustrates the marker device 10' as assembled in a compact, easily stowable package or arrangement P'. FIG. 6 illustrates the marker device 10' deployed or marking an underwater location.

The marker device 10' comprises a heavier-than-water weight member 20' typically molded or cast from a heavy metal, such as preferably lead. The weight member 20' comprises a central hub 22' and first and second peripheral flanges 24',26' extending radially from the hub and spaced apart to define a reel 28' on which an elongated connector line 30' is wrapped as shown in FIG. 5. The reel 28' is disposed about a central, axially extending pocket 29' of the weight member 20'. As mentioned, the weight member 20' can be molded or cast from lead to the configuration shown in FIG. 5.

The elongated connector line or string 30' comprises any suitable plastic or other material of a suitable length as described above for the FIG. 1-3 embodiment of the invention. One end 30*a*' of the connector line 30' is connected (tied) to the flange 24' of the weight member 20', FIG. 6. The other remote end 30*b*' of the connector line 30' is connected to the balloon 32' via the plastic cover member 70'. As shown best in FIG. 5, the end 30*b*' is wrapped and tied off in a peripheral groove 33'. The cover member 70' includes the valve 40' thereon. The valve 40' comprises the same valve components as shown for valve 40 in FIG. 3 except that valve head 56' seats against an annular surface 57' on the cross-member 52'.

The throat 32*a*' of the rubber balloon 32' is sealingly connected in the peripheral groove 71'' of the cover member 70' so that the valve 40' is thereby connected in gas flow communication to the balloon 32'. A rubber band (not shown but similar to rubber band 43 of FIG. 1) and a length of string may be wrapped about the balloon throat 32*a*' to insure air tight connection.

As shown in FIG. 5, the connector line 30' is wrapped (stored) on the reel 28' of the weight member 20' when the marker device 10' in the compact assembled package P'; i.e., when the marker device is not in use. The balloon 32' in the deflated condition is folded and received in the pocket 29' of the weight member 20' when the marker device 10 is in the compact assembled package P'. The cover member 70' is engaged (snap-fit) in a peripheral groove 31' of the eight member 20' to enclose the wrapped connector line an the deflated, folded balloon 32' received in the pocket 29' to form the compact, readily stowable disc-shaped package P'.

When the diver desires to mark a particular location underwater, the diver removes (unsnaps) the cover member 70' from the weight member 20' to remove the folded, deflated balloon 32' and unwrap a short length of the connector line 30'. The diver then introduces air into the balloon 32' through the valve 40' in the manner described above. The balloon 32' is thereby inflated. The diver then releases the inflated balloon 32' and cover 70' to float to the desired position at or below the surface of the water where it will mark the location. The balloon 32' carries the cover member 70' with it as it floats to the surface, FIG. 6. The connector line 30' readily unwinds from the reel 28' until the balloon 32' reaches the desired position. After the balloon 32' is at the surface, the diver can adjust the length of the connector line 30' and then fix the connector line to the weight member by wedging or looping the connector line about the weight member.

When the diver desires to remove the deployed marker device 10' from the marked location for use at another location or to stow it on the dive boat for subsequent use, the diver retrieves the inflated balloon 32' underwater or above the water, if the diver is in the dive boat, and simply passes the gas release member 62' (i.e., end 64' thereof) with a finger so as to unseat (open) the valve head 56' from the cross member rib 57' and allow the air to escape from the balloon 32' until it is suitable deflated. The diver then wraps the connector line 30' on the reel 28', places the deflated balloon 32' (after folding) in the pocket 29', and snaps the cover member 70' onto the weight member 20' as shown in FIG. 5.

Referring to FIG. 7 wherein like reference numerals double primed are used to designate like features of FIGS. 1-3, a marker device 10" in accordance with still another embodiment is shown. This marker device 10" is similar to marker device 10 of FIG. 1 with the exception that the cover member 70" encloses the entire upper side of the weight member 20" in FIG. 7 and in that a plurality of water drain holes 20a" are provided in the weight member 20" to provide a path of egress for water that might be trapped between the weight member 20" and cover member 70" when they are assembled.

While the invention has been described in terms of specific embodiments thereof, it is not intended to be limited thereto but rather only to the extent set forth in the appended claims.

I claim:

1. A marker device for marking an underwater location, comprising:

a) a heavier-than-water weight member having a reel thereon, b) an elongated connector line connected to the weight member and wrapped on the reel when the marker device is not in use and unwrapped from the reel when a location is to be marked, and c) an inflatable/deflatable marker balloon connected to the connector line, said balloon being stored on the weight member in the deflated condition when the marker device is not in use and removed from the weight member for inflation when a location is to be marked, and d) valve means connected to the marker balloon so as to communicate with the interior thereof for permitting introduction of gas therein to inflate the balloon and permitting release of gas therefrom for deflating the balloon.

2. The marker device of claim 1 further comprising a cover member for releasably engaging the weight member when the connector line is wrapped on the reel and the balloon is stored in the deflated condition on the weight member so as to enclose said connector line and said balloon.

3. The marker device of claim 1 wherein the weight member comprises a central hub and first and second peripheral flanges extending from the hub and spaced apart to define the reel on which the connector line is wrapped.

4. The marker device of claim 1 wherein said valve means comprises a gas inlet/outlet aperture through which gas can be introduced/released to inflate/deflate the balloon, a valve member openable relative to the aperture by application of gas pressure at the aperture from an air supply to inflate said balloon and closeable relative to the aperture by gas pressure in the inflated balloon after application of said gas pressure is discontinued to maintain inflation of said balloon, and a gas release member actuable from outside the balloon by the diver to open the valve member to release gas from the inflated balloon to deflate said balloon.

5. The marker device of claim I herein the valve means is sealingly received in a throat of the marker balloon.

6. A marker device for marking an underwater location, comprising:

a) a heavier-than-water weight member having a reel thereon, b) an elongated connector line attached to the weight member and wrapped on the reel when the marker device is not in use and unwrapped from the reel when a location is to be marked, and c) an inflatable/deflatable marker balloon connected to the connector line and wrapped on the reel in the deflated condition when the marker device is not in use and unwrapped from the reel for inflation when a location is to be marked, and d) valve means sealingly connected in one end of the balloon for permitting introduction of gas therein to inflate the balloon and permitting release of gas therefrom for deflating the balloon.

7. The marker device of claim 6 wherein the weight member comprises a central hub and first and second peripheral flanges extending from the hub and spaced apart to define the reel on which the connector line and the balloon are wrapped.

8. The marker device of claim 6 which further includes a cover member releasably engaging the weight member when the connector line and the weight member are wrapped on the reel so as to enclose said connector line and said marker balloon between said reel and said cover member, said cover member being removable from the weight member when said connector line and said marker balloon are to be unwrapped.

9. The marker device of claim 8 wherein the cover member is reengagable with the weight member after the connector line and the marker balloon are unwrapped and released to mark the location to clamp the connector line on the weight member.

10. The marker device of claim 8 wherein the cover member comprises a plastic cover adapted to snap fit onto the weight member.

11. The marker device of claim 6 wherein the valve means comprises a housing sealingly received in the balloon throat, a gas inlet/outlet aperture through which gas can be introduced/released to inflate/deflate the balloon, a flexible valve member overlying the aperture from inside the balloon such that said valve member is openable relative to the aperture by application of gas pressure at the aperture from an air supply to inflate said balloon and is closeable relative to the aperture by gas pressure in the inflated balloon after application of said gas pressure is discontinued to maintain inflation of said balloon, and a gas release member received in the aperture and actuable from outside the balloon by the diver to open the valve member to release gas from the inflated balloon to deflate said balloon.

12. A marker device for marking an underwater location, comprising:

a) a heaver-than-water weight member having a reel thereon, b) an elongated connector line attached to the weight member and wrapped on the reel when the marker device is not in use and unwrapped from the reel when a location is to be marked, c) a cover member connected to the connector line, said cover member being releasably engaged to the weight member when the connector line is wrapped on the reel to enclose said connector line and being removable from the weight member when the connector line is unwrapped for use in marking a location, d) an inflatable/deflatable marker balloon sealingly connected to the cover member and enclosed in the deflated condition between the cover member and the weight member when the cover member is engaged to the weight member to enclose the connector line, and e) valve means disposed on the cover member so as to communicate with the interior of the balloon for permitting introduction of gas therein to inflate the balloon and permitting release of gas therefrom for deflating the balloon.

13. The marker device of claim 12 wherein the weight member includes a central pocket about which the reel is disposed, said pocket being adapted to receive the deflated balloon when the cover member is engaged to the weight member.

14. The marker device of claim 13 wherein the cover member is snap fit onto the weight member.

15. The marker device of claim 12 wherein the weight member comprises a central hub and fist and second peripheral flanges extending from the hub and spaced apart to define the reel on which the connector line and the balloon are wrapped.

16. The marker device of claim 15 wherein the hub includes a pocket therein for receiving the balloon in the deflated condition when the cover member is engaged to the weight member.

17. The marker device of claim 12 wherein the balloon includes a throat that sealingly engages the cover member.

18. The marker device of claim 12 wherein the valve means comprises a gas inlet/outlet aperture through which gas can be introduced/released to inflate/deflate the balloon, a flexible valve member overlying the aperture from inside the balloon such that said valve member is openable relative to the aperture by application of gas pressure at the aperture from an air supply to inflate said balloon and is closeable relative to the aperture by gas pressure in the inflated balloon after application of said gas pressure is discontinued to maintain inflation of said balloon, and a gas release member received in the aperture and actuable from outside the balloon by the diver to open the valve member to release gas from the inflated balloon to deflate said balloon.

19. A marker balloon and valve assembly for an underwater marking device, comprising:

a) an inflatable/deflatable balloon, and b) valve means connected to the balloon so as to be in gas flow communication with the interior of said balloon, said valve means comprising a gas inlet/-outlet aperture through which gas can be introduced/released to inflate/deflate the balloon, a valve member openable relative to the aperture by application of gas pressure at the aperture from an air supply to inflate said balloon and closeable relative to the aperture by gas pressure in the inflated balloon after application of said gas pressure is discontinued to maintain inflation of said balloon, and a gas release member actuable from outside the balloon by a diver to open the valve member to release gas from the inflatable balloon to deflate said balloon.

20. A marker balloon and valve assembly for an underwater marking device, comprising:

a) an inflatable/deflatable balloon, and b) valve means sealingly connected in one end of the balloon, said valve means comprising a gas inlet/-outlet aperture through which gas can be introduced/released to inflate/deflate the balloon, a flexible valve member overlying the aperture from inside the balloon such that said valve member is openable relative to the aperture by application of gas pressure at the aperture from an air supply to inflate said balloon and is closeable relative to the aperture by gas pressure in the inflated balloon after application of said gas pressure is discontinued to maintain inflation of said balloon, and a gas release member received in the aperture and actuable from outside the balloon by a diver to open the valve member to release gas from the inflated balloon to deflate said balloon.

* * * * *

UNITED STATES PATENT AND TRADEMARK OFFICE

CERTIFICATE OF CORRECTION

PATENT NO. : 5 231 952

DATED : August 3, 1993

INVENTOR(S) : David M. TENNISWOOD

It is certified that error appears in the above-identified patent and that said Letters Patent is hereby corrected as shown below:

Column 7, line 60; replace "Claim I herein" with ---Claim 1 wherein---.

Column 9, line 14; replace "fist" with ---first---.

Column 10, line 17; replace "inflatable" with ---inflated---.

Signed and Sealed this

Twenty-ninth Day of March, 1994

*Attest:*

*Attesting Officer*

BRUCE LEHMAN

*Commissioner of Patents and Trademarks*